United States Patent [19]

Kasahara et al.

[11] 4,062,199

[45] Dec. 13, 1977

[54] REFRIGERATING APPARATUS

[75] Inventors: Keisuke Kasahara, Tokyo; Sachio Hamaoka, Ibaragi; Youichi Katori; Takaharu Mizuno, both of Ibaragi, all of Japan

[73] Assignee: Kabushiki Kaisha Maekawa Seisakusho, Tokyo, Japan

[21] Appl. No.: 699,090

[22] Filed: June 23, 1976

[30] Foreign Application Priority Data

June 24, 1975 Japan ..... 50-77898
Aug. 21, 1975 Japan ..... 50-101780

[51] Int. Cl.[2] ..... F25B 41/00

[52] U.S. Cl. ..... 62/197; 62/505; 418/97; 418/201

[58] Field of Search ..... 62/197, 505; 418/97, 418/201

[56] References Cited

U.S. PATENT DOCUMENTS

| | | | |
|---|---|---|---|
| 3,795,117 | 3/1974 | Moody, Jr. et al. | 62/197 |
| 3,859,815 | 1/1975 | Kasahara | 62/197 |
| 3,866,438 | 2/1975 | Endress | 62/468 |
| 3,885,402 | 5/1975 | Moody, Jr. et al. | 62/505 |
| 3,913,346 | 10/1975 | Moody, Jr. et al. | 62/197 |

*Primary Examiner*—Ronald C. Capossela
*Attorney, Agent, or Firm*—James E. Nilles

[57] ABSTRACT

A refrigerating apparatus comprising a refrigerating cycle into which a screw compressor is incorporated, and a liquid super cooler connected on the way of a liquid pipe of said refrigerating cycle, said screw compressor having a gas intake and/or liquid coolant injection opening which is located at a position where the screw blades of the screw compressor have at least partially compressed the gas in the screw compressor. The position of the gas intake provided in the screw compressor and intended to pass the gas from the liquid super cooler into the screw compressor is limited under such a condition that $$V_i = 1.0 \sim 4.5$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the gas intake. The position of the liquid injection opening provided in the screw compressor and intended to pass the liquid coolant into the screw compressor is limited under such a condition that $$V_i = 1.0 \sim 3.7$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the liquid coolant injection opening.

10 Claims, 20 Drawing Figures

REFRIGERATING APPARATUS

The present invention relates to a refrigerating apparatus embodying a so-called screw economizer system.

In the conventional refrigerating cycle using a screw compressor there has been developed a screw economizer system wherein for the purpose of super-cooling a liquid coolant which is fed from a reservoir to a main expansion valve, the liquid coolant of low temperature gained by reducing in pressure a part of the liquid through a subexpansion valve is stored in a liquid supercooler, into which a liquid pipe for feeding the liquid coolant is inserted to super-cool the liquid, and the gas generated in the liquid super cooler is sucked into the screw space of the screw compressor at a position corresponding to the halfway in the course of the gas compression stroke. However, in this screw economizer system no concrete development is provided as to the position and the size of a gas intake through which the gas is sucked from the liquid super cooler and which is provided in the screw compressor.

There has also been developed a screw liquid injection system in which a part of liquid coolant which is fed from a reservoir of an oil injection type screw compressor to a main expansion valve is ejected into the screw space of the screw compressor at a position corresponding to the halfway in the course of the gas compression stroke, so that compressed gas and oil are cooled. However, it is difficult to certify theoretically the effect and efficiency of the liquid injection system and the position and the size etc. of the liquid coolant injection opening have not yet calculated quantitatively.

The present invention is intended to realize a screw economizer system by quantitatively defining the position and the size of the gas intake through which the gas is inhaled from the liquid super cooler into the screw compressor.

A primary object of the present invention is to provide a refrigerating apparatus wherein the position and the size of the liquid coolant injection opening is defined quantitatively, so that the effect of the liquid coolant injection is enhanced.

Further object of the present invention is to provide a refrigerating apparatus wherein the position of the gas intake through which the gas is sucked from the liquid super cooler into the screw compressor is arranged to have $V_i$ in the range of 1.0 – 4.5 in the screw economizer system, in which $V_i$ represents an internal volume ratio at the position of the gas intake. According to the present invention, the pressure in the liquid super cooler can be kept lower than the condensing pressure so as to enhance the liquid super-cooling effect. Further, the present invention requires no additional device or control for enabling the gas to be sucked from the liquid super cooler into the screw compressor. Furthermore, the gas intake is located at a comparatively low position such as $V_i$ is in the range of 1.0 – 4.5 so that the internal pressure in the gas intake shows little change, thus allowing a continuous intake of the gas from the liquid super cooler to be attained.

Further object of the present invention is to provide a refrigerating apparatus wherein the area factor C of the gas intake is arranged to be in the range of 0.1 – 2.5. According to the present invention the intake of gas from the liquid super cooler is so proper as to be advantageous in the enhancement of a resulting factor.

Further object of the present invention is to provide a refrigerating apparatus wherein the position of the liquid coolant injection opening provided in the course of the gas compression stroke is arranged to have $V_i$ in the range of 1.0 – 3.7. According to the present invention, the pressure in the compressor at the position of the liquid coolant injection opening is a suitable in value, the evaporation temperature is in the range of generally usable condition, and the discharging temperature is in the permissible range. Further, as shown in FIG. 12 the resulting factor can be reached without using any oil cooler to a value in the case that a separated oil cooler using water cooling etc. is provided.

Further object of the present invention is to provide a refrigerating apparatus wherein the area factor C of the liquid coolant injection opening is arranged to be more than 0.02. According to the present invention the discharging temperature can be controlled in the permissible range as shown in FIG. 14.

Further object of the present invention is to provide a refrigerating apparatus wherein the liquid coolant injection opening is located at the circumferential portion of the rotor casing except the portion where a slide valve is provided or at the end face of the discharge side of the bearing head of the compressor. According to the present invention the formation of the opening is easy and the gas seal effect can be enhanced. The present invention can also be applied in the case that a super cooler is provided.

These and other objects as well as the merits of the present invention will be apparent from the following description with reference to the accompanying drawings, in which FIG. 1 is a flow sheet diagram showing an embodiment of the present invention in case that gas is injected;

Figure 1:
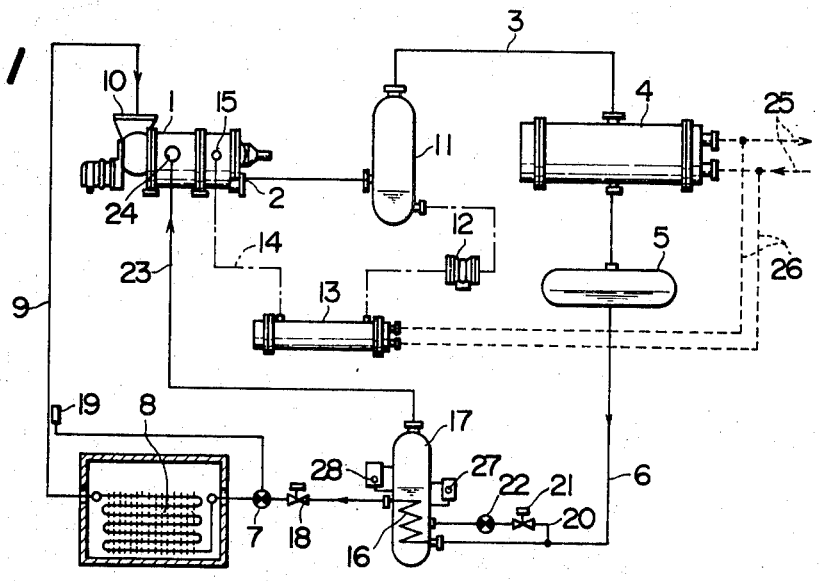

In FIG. 1 a cooling cycle comprises a screw compressor 1 having a discharging opening 2, a gas discharging pipe 3, a condenser 4, a reservoir 5, a liquid pipe 6 for liquid coolant, a main expansion valve 7, an evaporator 8, a gas intake pipe 9 and an intake 10. An oil separator 11 is arranged between the discharging opening 2 and the gas discharging pipe 3. Between an oil discharging opening of the oil separator 11 and an oil intake 15 of the compressor 1 are also arranged an oil pump 12, an oil cooler 13 and an oil pipe 14. A super cooling portion 16 of the liquid pipe 6 located between the reservoir 5 and the main expansion valve 7 is contained in a liquid super cooler 17, and to the liquid pipe 6 located between the liquid super cooler 17 and the main expansion valve 7 is arranged a solenoid valve 18 which is operated synchronizing to the compressor 1. The main expansion valve 7 is connected with a thermosleeve 19 for detecting the temperature of the gas flowing through the gas intake pipe 9, so that the opening and the closing of the main expansion valve 7 may be automatically adjusted responding to the temperature of the gas sucked. The liquid super cooler 17 is communicated with a liquid pipe 20 branched from the liquid pipe 6 through a solenoid valve 21, which is synchronized to the compressor 1, and a sub-expansion valve 22, and the gas extracted from the gas phase portion of the liquid super cooler 17 is communicated with a gas intake 24 through a gas intake pipe 23, said gas intake 24 being arranged at a position where the screw blades of the screw compressor 1 have at least partially compressed the gas in the screw compressor 1. In the Figure numeral 25 represents a cooling water pipe for the condenser 4, 26 a water pipe for the oil cooler, and 27 and 28 float valves.

Figure 2:
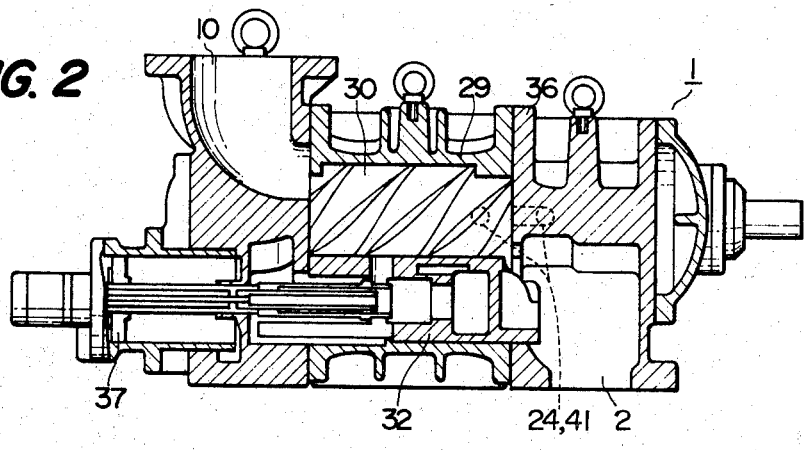
FIG. 2 is a longitudinal of a screw compressor.
Figure 3:
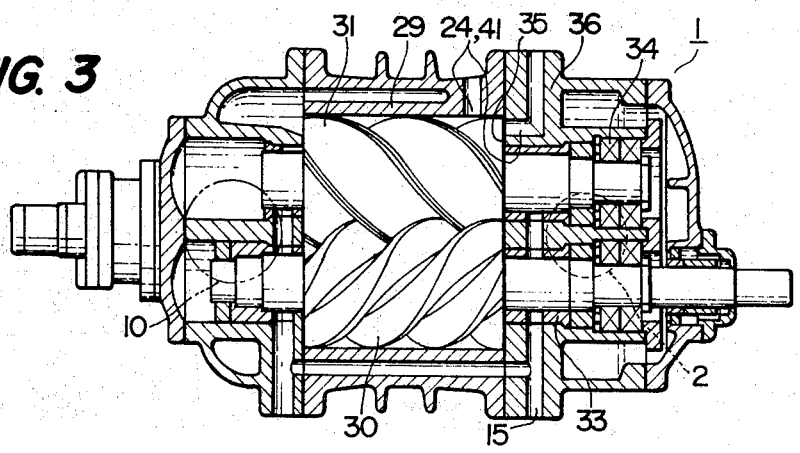
FIG. 3 is a cross section of the screw compressor shown in FIG. 1.

There will be now described the screw compressor 1 shown in FIGS. 2 and 3. In these Figures numeral 29 represents a rotor casing, 30 a male rotor, 31 a female rotor, 32 a slide valve, 33 a bearing, 34 a thrust bearing, 35 an end face of the bearing located at the rotor casing side, 36 a bearing head, and 37 an unloader piston. The gas intake 24 is provided at either or both of the rotor casing 29 and the bearing head 36.

There will be now described how the embodiment of the present invention shown in FIGS. 1 through 3 is operated. A gas coolant compressed in the screw compressor 1 is liquefied in the condenser 4, stored in the reservoir 5, and super-cooled passing through the liquid super cooler 17 on the way of flowing to the evaporater 8 through the liquid pipe 6. A liquid coolant of low temperature which is reduced in pressure is introduced into the liquid super cooler 17 through the liquid pipe 20 branched from the liquid pipe 6 so as to cool the liquid pipe portion 16 housed in the liquid super cooler 17. The gas retracted from the liquid super cooler 17 is fed through the gas intake pipe 23 to the gas intake 24 located at a position where the screw blades of the screw compressor 1 have at least partially compressed the gas in the screw compressor 1. The super-cooled liquid is fed through the main expansion valve 7 to the evaporator 8 to cool the load side of the evaporator 8 and gasified to be sucked through the intake 10 into the compressor 1.

There will be now considered the position of the gas intake 24 which is provided at a position where the screw blades of the screw compressor 1 have at least partially compressed the gas in the screw compressor 1 and which is intended to pass the gas into the screw compressor 1. The fact that the gas intake 24 is located at a position where the screw blades of the screw compressor 1 have at least partially compressed the gas in the screw compressor 1 means that the gas from the liquid super cooler 17 is introduced into the compressor 1 after completion of the gas intake stroke, thus allowing the intake of the gas from the evaporator 8 to be attained without any hindrance. Namely, it means that only the gas coolant from the liquid super cooler 17 is super-charged into the compressor 1. Since the gas intake 24 is located at a position where the screw blades of the screw compressor 1 have at least partially compressed the gas in the screw compressor 1, the super-charged gas coolant is compressed when in intermediate pressure, so that there is only a little increase in shaft driving power to attain a better resulting factor. However, there is still left unsolved the problem as to the position of the gas intake 24, that is, at what position in the course of the gas compression stroke in the compressor 1 the gas intake 24 should be located.

Now, assuming that the theoretically largest screw space volume in the compressor 1 be $V_L$ and that the screw space volume at the position of the gas intake 24 be $V_H$, the internal volume ratio $V_i$ at the position of the gas intake 24 can be expressed as follows:

$$V_i = V_L / V_H$$

When $V_i$ is low, the gas intake 24 will be located near the intake 10 in the course of the gas compression stroke and the gas intake 24 will come nearer the discharging opening 2 as $V_i$ becomes higher. When $V_i = 1$, the gas intake 24 will be located immediately after the compression of the gas starts in the rotors of the compressor 1 and when the value of $V_i$ is high, the gas intake 24 will be located after the gas has been most highly compressed, so that the pressure and the temperature in the liquid super cooler 17 communicated with the gas intake 24 will become higher to prevent the liquid from being super-cooled.

Figure 4:
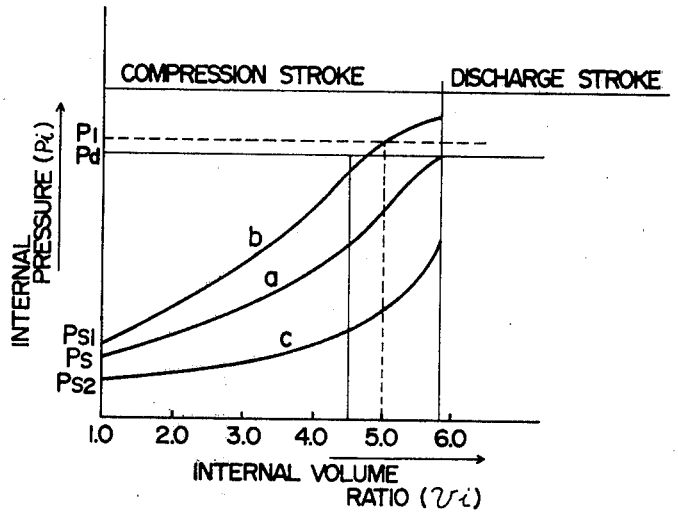
FIG. 4 is a graph showing the relation between an internal pressure and an internal volume ratio.
Figure 5:
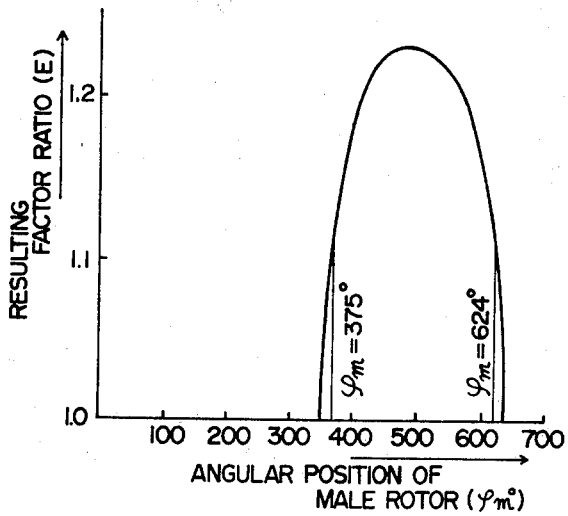
FIG. 5 is a curve showing the relation between the position of the gas intake according to the angular position of a male rotor and the resulting factor ratio.
Figure 7:
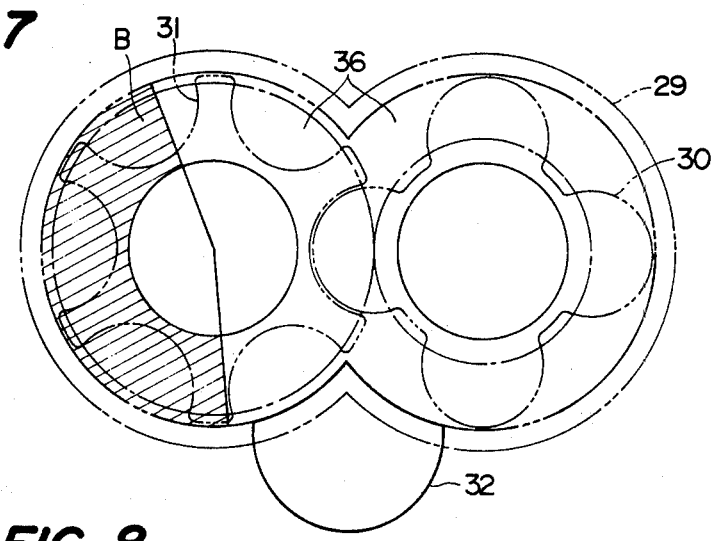
FIG. 7 is a view showing an end face of a bearing head located at the rotor casing side.

FIG. 4 shows the relation between the internal pressure and the internal volume ratio $V_i$ in the screw compressor 1. A curve *a* represents changes in the internal pressure according to the design condition of intake pressure $P_s$ and discharging pressure $P_d$, a curve *b* shows changes in the internal pressure when the intake pressure rises to $P_{s1}$, and a curve *c* shows changes in the internal pressure when the intake pressure drops to $P_{s2}$. In this case assuming that the gas intake 24 be located at such a position as the internal volume ratio $V_i$ is high, for example, 5.0, the internal pressure $P_1$ at the gas intake 24 will become higher than the discharging pressure $P_d$, namely, the condensing pressure when the intake pressure rises to about $P_{sl}$, so that the pressure in the liquid super cooler 17 will become higher than the condensing pressure. As apparent from this, the position of the gas intake 24 is practically limited to a range at which the value of $V_i$ is low. For example, in the case of the curve *a*, assuming that the internal volume ratio $V_i$ at the gas intake 24 be 4.5, the internal pressure at the gas intake 24 will never rise higher than the discharging pressure of design condition even when the intake pressure rises to $P_{s1}$. In the case the number of teeth of the male rotor is four and the helical angle of the teeth is 300°, the practical position of the gas intake 24 corresponds to an angular position $\phi m°$ of the male rotor is in the range of 375 – 624, as shown in FIG. 5. (When the male rotor 30 is located at a position as shown in FIG. 7 at the end face thereof viewed from the side of the rotor casing in which the intake is provided at the time when the gas intake stroke starts $\phi m°$ will be equal to 0). This means that the range of $V_i$ is 1 - 4.5. When $V_i$ is in the range of 1 - 4.5, a good resulting factor and an increase in refrigerating capacity are gained as well as a continuous intake of the gas coolant from the liquid super cooler 17 can be attained since there is little change in the internal pressure at the position of the gas intake 24 in the compressor 1.

Figure 6:
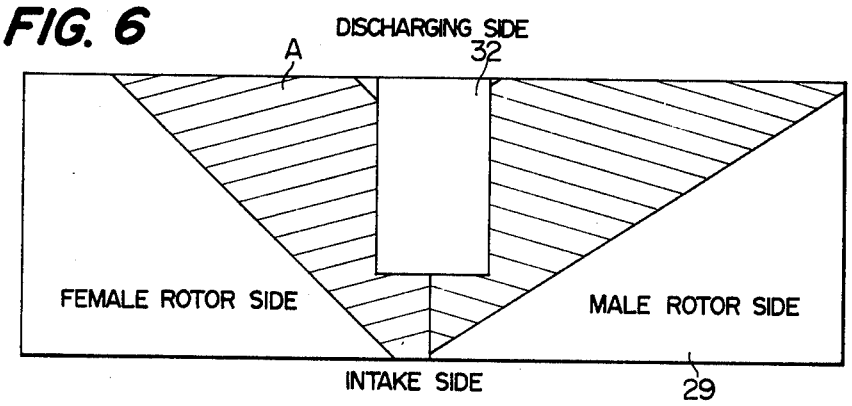
FIG. 6 is a view showing a rotor casing developed.

The position of the gas intake 24 is further limited by the distance from the portion at which the gas inside the compressor 1 is likely to leak and by the time period during which the gas intake is opened to the screw space portion. For example, with the screw space portion to which the gas intake 24 is opened under the condition that $V_i = 1.0 \sim 4.5$ are contacted the rotor casing 29, the bearing head 36, the slide valve 32, and the male and the female rotors 30 and 31, but the slide valve 32 is most likely to cause the leakage of the gas in the compressor 1. Further, it is difficult to provide in the compressor 1 the gas intake 24 capable of being communicated with the gas intake pipe 23 due to the oil ejection mechanism and the complexity of the internal construction of the compressor 1, and the gas intake 24 provided at a position near which the male rotor 30 is engaged with the female rotor 31 causes the volume efficiency to be degraded. Further, at the side of the bearing head 36 contacted with the end face of the male rotor 30 the sectional area of the side face of the tooth of the male rotor 30 is wide so as to make narrow the space sectional area for intake and the rotation of the male rotor 30 is faster than that of the female rotor 31. Therefore, it is not proper to provide the intake 24 at the side of the male rotor 30. On the contrary, at the side face of the bearing head 36 contacted with the end face of the female rotor 31 the width of the side face of the tooth of the female rotor 31 is narrow so as to make larger the time period during which the gas intake 24 is opened to the screw space and the female rotor 31 drives more slowly than the male rotor 30. Therefore, the time of intake becomes longer and the intake of gas from the liquid super cooler 17 becomes larger than at the side of the male rotor, so that it is proper to provide the gas intake 24 at the side of the female rotor 31. Apparent from the above, it is proper to locate the gas intake 24 at a circumferential portion A of the rotor casing 29 including no portion into which the slide valve 32 is inserted and being shown by oblique lines in FIG. 6 or at a portion B of the side face of the bearing head 36 which is located at the side of the female rotor 31 and which is shown by oblique lines in FIG. 7. These portions A and B can be expressed by the equation $V_i = 1.0 \sim 4.5$.

Next, there will be considered the relation between the area of the gas intake 24 and the resulting factor.

Figure 8:
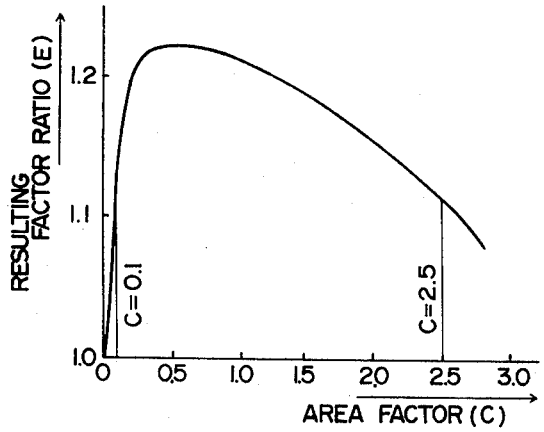
FIG. 8 is a curve showing the relation between the area factor of the gas intake and the resulting factor ratio.

In FIG. 8 the resulting factor ratios E obtained by dividing the resulting factors of the screw compressor 1 having the economizer of the present invention by those of the screw compressor having no economizer are plotted on the axis of ordinate while the area factors C gained by dividing the sectional areas ($mm^2$) of the gas intake 24 by the theoretical exhaustion volumes ($m^3/h$) are plotted on the axis of abscissa. As apparent from FIG. 8, when the area factors are extremely low, the intake of gas from the liquid super cooler 17 decreases and therefore, it can not be expected that the refrigerating capacity and the resulting factor are enhanced. On the contrary, when the area factors are arranged to be extremely large, the flow of gas through the gas intake 24 increases at the starting period of the intake of gas from the liquid super cooler 17 and the internal pressure in the compressor 1 excesses the pressure in the liquid super cooler 17 before communication between the gas intake 24 and the screw space portion is completed. Due to this, a reversing flow of gas is caused through the screw space portion to decrease the volume efficiency and the resulting factor. Therefore, it is proper that the sectional area of the gas intake 24 is in the range of 0.1 - 2.5.

An embodiment shown in FIG. 9 will be explained.

Figure 9:
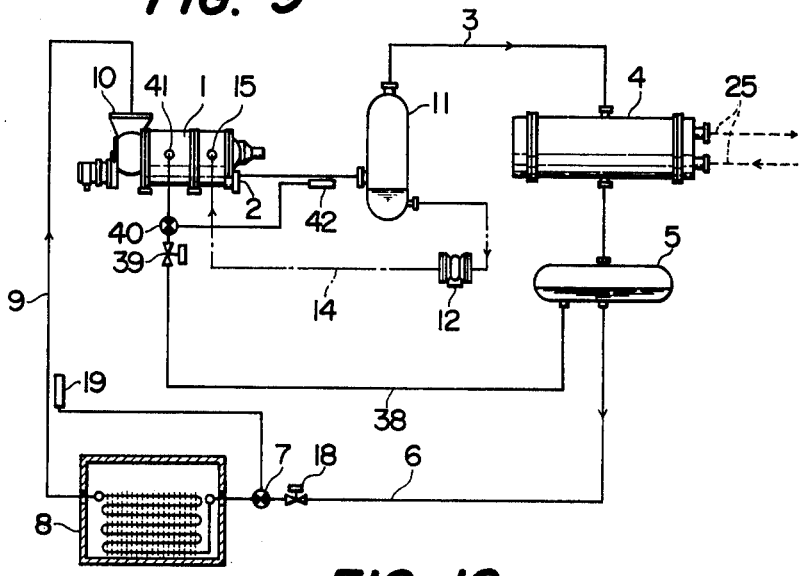
FIG. 9 is a flow sheet diagram showing an embodiment of the present invention in case that liquid is injected.

In FIG. 9 a cooling cycle comprises an oil injection type screw compressor 1 having a discharging opening 2, a gas discharging pipe 3, a condenser 4, a reservoir 5, a liquid pipe 6 for liquid coolant, a solenoid valve 18, a main expansion valve 7, an evaporator 8, a gas intake pipe 9 and an intake 10. An oil separator 11 is arranged between the discharging opening 2 and the gas discharging pipe 3. Between an oil discharging opening of the oil separator 11 and an oil intake 15 of the compressor 1 are also arranged an oil pump 12 and an oil pipe 14. A liquid injection pipe 38 connected to the reservoir 5 is communicated with a liquid coolant injection opening 41 through solenoid valve 39 and a sub-expansion valve 40, said opening being arranged at a position where the screw blades of the screw compressor 1 have at least partially compressed the gas in the screw compressor 1. In the Figure numeral 25 represents a cooling water pipe for the condenser 4. Said solenoid valves 18, 39 are operated by the start and stop of said compressor 1 or by the control in the performance, respectively. The main expansion valve 7 and sub-expansion valve 39 are connected with thermosleeves 19, 42 for detecting the temperatures of the gas intake pipe 9 and the gas discharging pipe 3, so that the opening and the closing of the main expansion valve 7 and sub-expansion valve 39 may be automatically adjusted responding to the temperatures. The construction of the oil injection type screw compressor 1 is identical that of the screw compressor 1 shown in FIGS. 2 and 3.

There will be now described how the embodiment of the present invention shown in FIG. 9 is operated. A gas coolant compressed in the screw compressor 1 is liquefied in the condenser 4, stored in the reservoir 5, fed through the main expansion valve 7 to the evaporator 8 to cool the load, and sucked through the intake 10 into the compressor 1. A liquid from the reservoir 5 is fed through the liquid injection pipe 38 and the sub-expansion valve 40 to the liquid coolant injection opening 41, so that the liquid is reduced automatically in pressure according to the temperature of the gas discharged. The liquid injected into the screw space of the screw compressor at a position corresponding to the halfway in the course of the gas compression stroke takes compression heat by evaporation latent heat thereof, so that the compressed gas and oil injected from the oil intake 15 are coooled. Said cooled gas and oil are taken out at 50° - 60° C, and separated in the oil separator 12. The oil from the oil seaprator 12 is fed again to the oil intake 15 of the compressor 1 without cooling on the way. The oil from the oil intake 15 is supplied to the way in the course of gas compression stroke by the rotors 30, 31 of the compressor 1 and to the bearing portions, cooled again with compressed gas by the injected liquid coolant in the rotors 30, 31, and discharged.

The position of the liquid coolant injection opening will now be discussed.

If the liquid coolant injection opening 41 is provided on a way in the course of gas intake stroke, the intake gas from the evaporator 8 is reduced in quantity by the disturbance due to the re-expansion of the liquid coolant, so that the cooling effect and the resulting factor are deteriorated. Accordingly, the liquid coolant injection opening 41 is provided on the way in the course of the gas compression stroke where the screw blades of the screw compressor have at least partially compressed the gas in the screw compressor.

If the liquid coolant injection opening 41 is positioned where $V_i$ is high, a better resulting factor can be obtained but the internal pressure of the compressor 1 at the position of liquid coolant injection opening 41 becomes high and the intake of the liquid coolant from the reservoir 5 is difficult, where $V_i = V_L / V_H$, $V_L$ is the theoretically largest screw space volume in the screw compressor 1, and $V_H$ is the screw space volume at the position of the liquid coolant injection opening.

Figure 10:
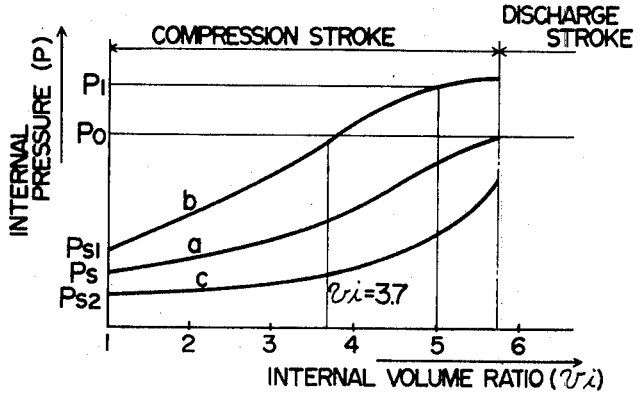
FIG. 10 is a graph showing the relation between an internal pressure and an internal volume ratio.

FIG. 10 shows the relation between the internal pressure P and the internal volume ration $V_i$ in the screw compressor 1. A curve *a* represents changes in the internal pressure P according to the design condition of intake pressure $P_s$ and discharging pressure $P_o$, a curve *b* shows changes in the internal pressure P when the intake pressure rises to $P_{s1}$, and a curve *c* shows changes in the internal pressure P when the intake pressure drops to $P_{s2}$. In this case assuming that the liquid coolant injection opening 41 be located at such a position that the internal volume ratio $V_i$ is high, for example, 5.0, the internal pressure $P_1$ at the opening 41 will become higher than the discharging pressure $P_o$, namely, the internal pressure of the reservoir 5 when the intake pressure rises to about $P_{s1}$, so that the intake of the liquid coolant from the reservoir 5 will become impossible. Accordingly, the temperatures of the discharged gas and the oil are elevated, so that the cooling and sealing of the compressed gas between the rotors 30, 31, lubricating of the radial bearing 33, thrust bearing 34, mechanical seal and rotors 30, 31, and operating of the compressor 1 can not be attained. However, if the liquid coolant injection opening 41 is located at a position where $V_i$ is lower than 3.7, the internal pressure $P_1$ at the opening 41 will not become higher than the discharging pressure $P_o$ when the intake pressure rises to about $P_{s1}$, so that the intake of the liquid coolant will become possible and the temperature of oil can be maintained at low value at which the compressor can be operated.

Figure 11:
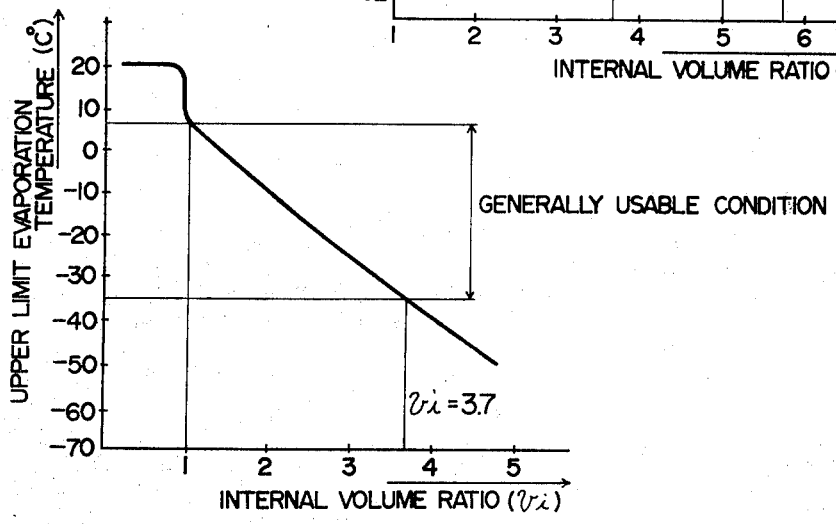
FIG. 11 is a curve showing the relation between an upper limit evaporation temperature and an internal volume ratio.

FIG. 11 shows a relation between an upper limit evaporation temperature in the evaporator 8 and internal volume ratio $V_i$. The evaporator 8 is pratically used at + 7° C~ − 35° C. The efficiency of the evaporator 8 becomes low, if the evaporation temperature lower than − 35° C is adopted by single stage compression. As shown in FIG. 11, the evaporation temperature of + 7° C~ − 35° C can be obtained if the opening 41 is located at a position where $V_i$ is in the range of 1 - 3.7, so that it is suitable to locate the opening 41 at the position mentioned above.

Figure 12:
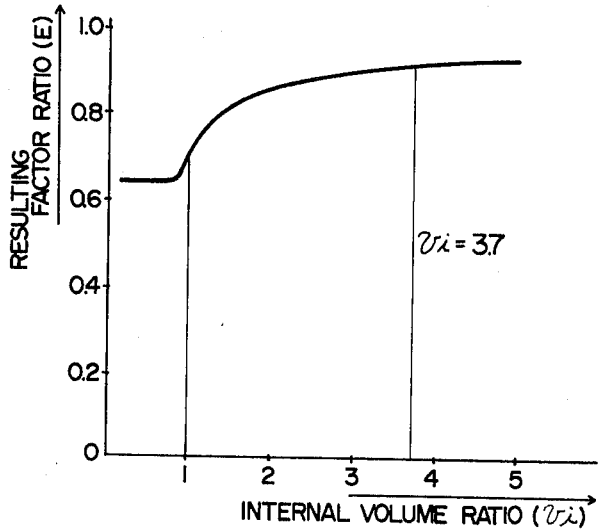
FIG. 12 is a curve showing the relation between the resulting factor ratio and an internal volume ratio.

FIG. 12 shows the relation between the resulting factor E and an internal volume ratio $V_i$. The resulting factor E can be expressed as $E = E_1 / E_2$, where $E_1$ is the resulting factor of the oil injection type screw compressor not having oil cooler but having a liquid coolant injection opening 41 and $E_2$ is the resulting factor of the oil injection type screw compressor having an additional oil cooler, into which no liquid coolant is injected. As shown in FIG. 12, the latter mentioned compressor is superior than the former mentioned compressor in view of the resulting factor. However, if the position of the opening 41 aproaches from a position where $V_i$ is 1 to a position where $V_i$ is 3.7, the resulting factor $E_1$ of the compressor having no oil cooler approaches to the resulting factor $E_2$ of the compressor having an oil cooler and the resulting factor E is not increased if $V_i$ is larger than 3.7.

As stated above, it is preferable that the opening 41 is located at a position where $V_i$ is in the range of 1 - 3.7.

Figure 13:
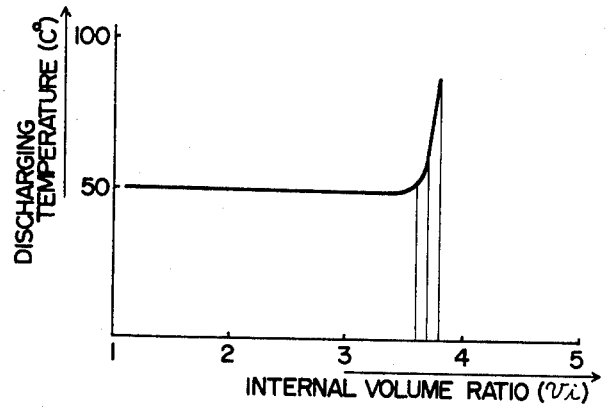
FIG. 13 is a curve showing the relation between a discharging temperature of gas and oil and an internal volume ratio.
Figure 20:
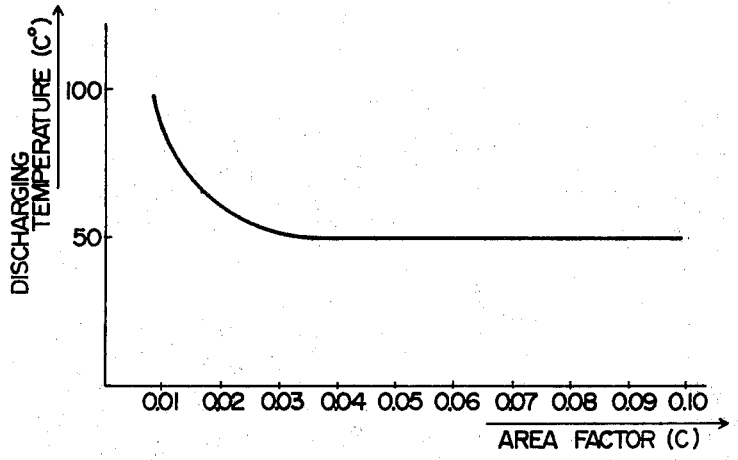
FIG. 20 is a curve showing the relation between a discharging temperature and the area factor of the liquid coolant injection opening.

FIG. 13 shows the relation between the discharging temperature of the gas and oil and an internal volume ratio $V_i$. It is not desirable to elevate the discharging temperature of the gas and oil of the compressor upper than 50° C - 60° C in view of protection of the radial bearing 33, thrust bearing 34 and mechanical seal. As shown in FIG. 13, the discharging temperature is 50° C - 60° C when the liquid coolant injection opening 41 is located at a position where $V_i$ is 1 - 3.7 and the discharging temperature is elevated rapidly when $V_i$ is increased upper than 3.7 so that the compressor in not operated. FIG. 20 shows the relation between the discharging temperature and the area factor C of the liquid coolant injection opening 41. The area factor C can be expressed as the areas ($mm^2$) of the liquid coolant intake divided by the volumes ($m^3/h$) of theoretically largest screw space of screw compressor. As shown in FIG. 20, the discharging temperature becomes 53° C at $V_i = 36$ and C = 0.03, the discharging temperature becomes 60° C at C = 0.02, and the discharging temperature becomes 90° C at C = 0.01, so that C should be limited to more than 0.02.

Figure 14:
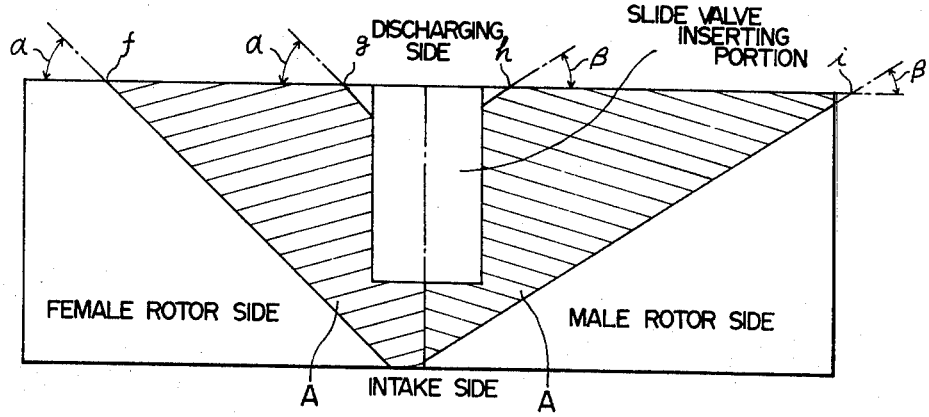
FIG. 14 is a view showing a rotor casing developed.

The position of the liquid coolant injection opening 41 is limited by the distance from the portion where the gas in the compressor 1 is likely to leak and by the problem in the process. For example, with the screw space portion to which the liquid coolant injection opening 41 is opened under the condition that $V_i = 1.0 \sim 3.7$ are contacted the rotor casing 29, the bearing head 36, the slide valve 32, and the male and the female rotors 30 and 31, but the slide valve 32 is most likely to cause the leakage of the gas in the compressor 1, because it is provided at a position near which the male rotor 30 is engaged with the female rotor 31, so called blow hole in the axial direction. If the opening 41 is positioned at this portion mentioned above, the cooling ability and resulting factor are degraded. Further, it is difficult to provide in the compressor 1 the opening 41 capable of being communicated with the liquid injection pipe 38 due to the oil supply mechanism and the complexity of the internal construction of the compressor 1. Apparent from the above, it is proper to locate the liquid coolant injection opening 41 at a portion A shown by oblique lines in FIG. 14 or at a portion corresponding to a portion B of the side face of the bearing head 36, shown by oblique lines in FIG. 15. These portions A and B can be expressed by the equation $V_i = 1 \sim 3.7$. In FIG. 14, $\alpha$ and $\beta$ can be expressed as follows:

$$\alpha = \tan^{-1} \frac{\text{female rotor lead}}{\text{diameter of female rotor} \times \pi}$$

-continued $$\beta = \tan^{-1}\frac{\text{male rotor lead}}{\text{diameter of male rotor} \times \pi}$$

Figure 15:
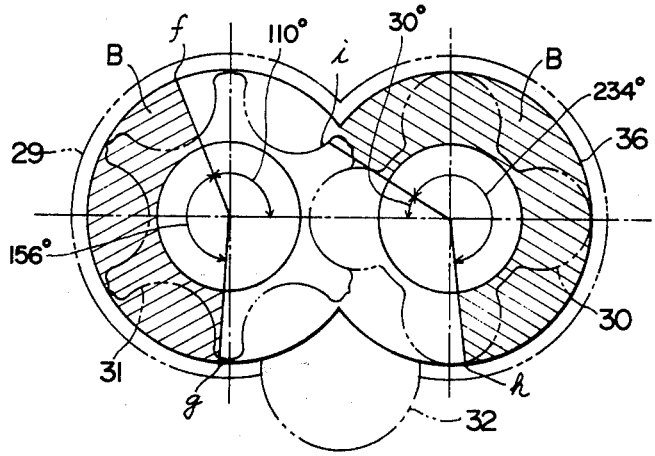
FIG. 15 is a view showing an end face of a bearing head located at the rotor casing side.

In FIGS. 14 and 15, points *f, g* correspond to points *h, i,* respectively.

Figure 16:
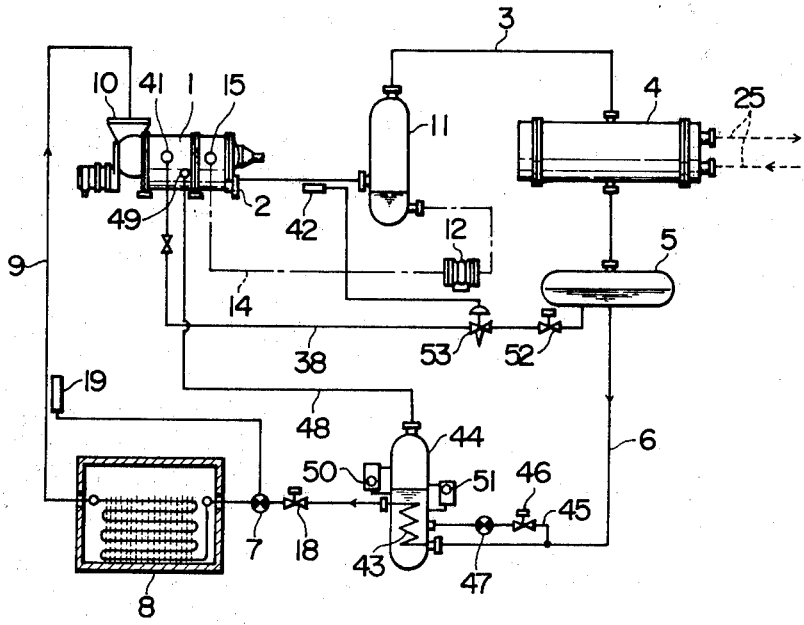
FIGS. 16 to 19 are flow sheets showing another embodiments of the present invention.

In FIG. 16, a liquid super cooler 44 are provided so that gas is further injected into the halfway in the course of the gas compression stroke of the compressor. A super cooling portion 43 is inserted into the liquid super cooler 44. The liquid super cooler 44 is communicated with a liquid pipe 45 branched from the liquid pipe 6 through a solenoid valve 46 and an expansion valve 47. The gas extracted from the liquid super cooler 44 is communicated with a gas injection opening 49 through a gas intake pipe 48, said opening 49 being arranged at a portion corresponding to the halfway in the course of the gas compression stroke at which $$V'i = \frac{\text{volume of theoretically largest screw space}}{\text{volume of screw space at the position of gas intake}} = 1.0 \sim 4.5.$$

In the Figure, reference numerals 50 and 51 represent float switches for operating the solenoid valve 45. In this embodiment the liquid is super cooled and fed to the main expansion valve 7. The gas of low temperature is injected through the gas injection opening 49 into the compressor separately from the liquid injected through the liquid coolant injection opening 41 located at a position where $V_i = 1 \sim 3.7$. The construction and function of the other portion are identical with that of the embodiment shown in FIGS. 9 to 15.

Figure 17:
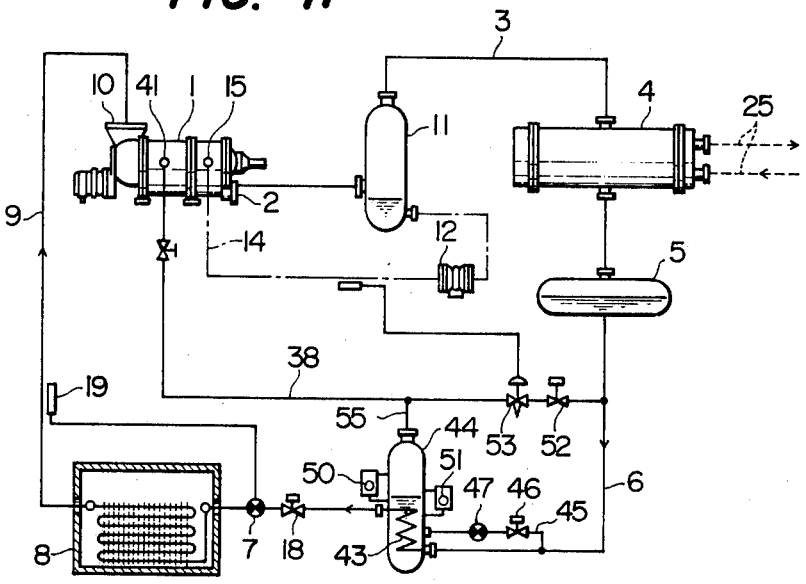

FIG. 17 shows another embodiment of the present invention in which a liquid super cooler is provided. In this embodiment, liquid and gas are injected into the compressor 1 through the same injection pipe and opening. Namely, a liquid super cooling portion 43 of the liquid pipe 6 is inserted into the liquid super cooler 44 and the liquid super cooler 44 is communicated with a liquid pipe 45 branched from the liquid pipe 6 through a solenoid valve 46 and an expansion valve 47. The reservoir 5 is communicated with a liquid coolant injection opening 41 located at a positon of the compressor 1 where $V_1 = 1 \sim 3.5$ through a liquid injection pipe 38 branched from the liquid pipe 6 and through a solenoid valve 52 and thermal type expansion valve 53. The gas extracted from the liquid super cooler 44 is communicated with said opening 41 through a gas intake pipe 55. In the Figure, reference numerals 50 and 51 show float switches for the solenoid valve 46.

In this embodiment, both liquid and gas can be injected from the liquid injection pipe 38 through the liquid coolant injection opening 41. Namely, liquid is fed to the liquid injection pipe 38 by opening the thermal type expansion valve 53 and at the same time gas is fed to the pipe 38 from the liquid super cooler 44 through the pipe 55, so that both liquid and gas are injected into the compressor 1 through the liquid coolant injection opening 41. In the other case, the thermal type expansion valve 53 is closed and gas and liquid from the liquid super cooler 44 are injected into the compressor 1 through the opening 41. The construction and function of the other portion are identical with that of the embodiment shown in FIG. 16.

Figure 18:
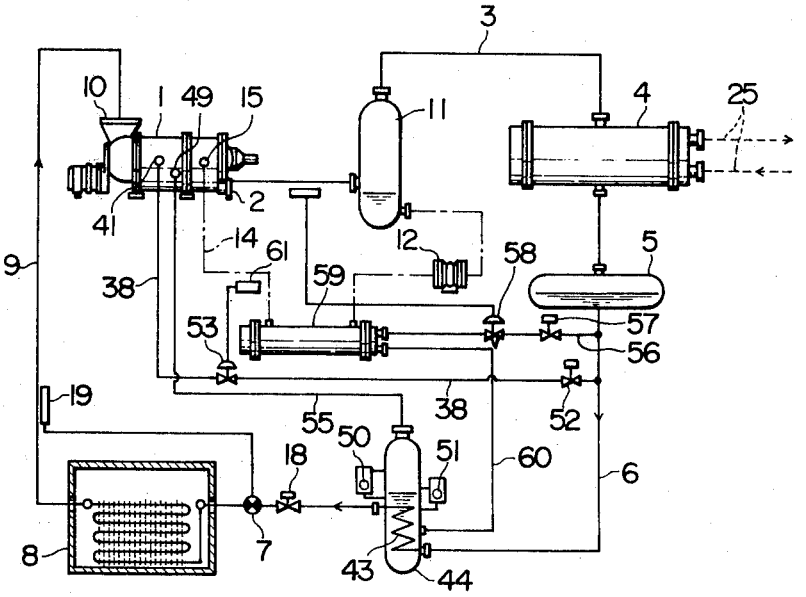

FIG. 18 shows another embodiment of the present invention in which a direct expansion type oil cooler and liquid super cooler are provided. Namely, in this embodiment, a liquid pipe 56 branched from the liquid pipe 6 is communicated through a solenoid valve 57, thermal type expansion valve 58, an oil cooler 59, and an oil pipe 14 with the oil intake 15 of the compressor 1. Low pressure liquid is fed through a pipe 60 with a liquid super cooler 44 having therein a liquid super cooling portion 43 of the liquid pipe 6, and a gas pipe 55 of the liquid super cooler 44 is communicated with the compressor 1 through a liquid coolant injection opening 49 located at a position where $V'_i = 1.0 \sim 4.5$. A liquid injection pipe 38 branched from the liquid pipe 6 is communicated with a liquid coolant injection opening 41 of the compressor 1 through a solenoid valve 52 and a thermal type expansion valve 53, the solenoid valve 57 being connected with float switches 50 and 51 of the liquid super cooler 44 and the expansion valve 53 being connected with a thermosleeve 61 for detecting the temperature of the oil pipe 14.

In this embodiment, the oil cooler 59 is cooled by the liquid coolant without using cooling water. Namely, when the thermal type expansion valve 58 is opened liquid coolant reduced in pressure from the branch pipe 56 cools the oil cooler 59 and is then fed to the liquid super cooler 44 for super cooling the liquid in the liquid super cooling portion 43. At low temperature and intermediate pressure, gas from the liquid super cooler 44 is injected into the compressor 1 through the gas injection opening 49 of the compressor 1 and cools the compressor 1. Liquid is injected into the compressor 1 through the liquid coolant injection opening 41 and serves to absorb the compression heat of the compressor 1 and to make gas seal with oil. The thermal type expansion valves 58 and 53 are automatically operated by the discharging gas temperature and oil temperature, respectively. The construction and function of the other portion are identical with that of the embodiment shown in FIGS. 9 to 15.

Figure 19:
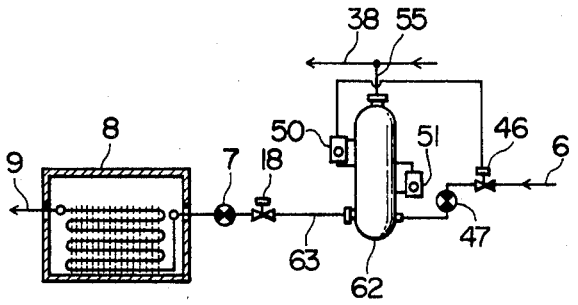

FIG. 19 shows the other embodiment of the present invention. In this embodiment, a liquid super cooler 62 is connected with the liquid pipe 6 through a float expansion valve 47 and float solenoid valve 46 connected with a float switch 50 of the liquid super cooler 62, and a low pressure liquid pipe 63 from the liquid super cooler 62 is communicated with the evaporator 8 through a solenoid valve 18 and main expansion valve 7. A gas pipe 55 from the liquid super cooler 62 is communicated with the gas injection opening 49 of the compressor 1 or communicated with the liquid injection pipe 38. When the float solenoid valve 46 and float expansion valve 47 are opened liquid reduced in pressure is stored in the liquid super cooler 62 and super cooled low temperature liquid is fed to the main expansion valve 7. The construction and function of the other portion are identical with that of the embodiment shown in the former embodiment in which the liquid super cooler 44 is used. The liquid in the embodiment shown in FIG. 19 is more cooled than the liquid in the embodiments shown in FIGS. 16 to 18. The liquid pressure of the former is lower than the latter.

What is claimed is:

1. A refrigerating apparatus comprising a refrigerating cycle into which a screw compressor, a condenser, an expansion valve, and an evaporator are incorporated, and a liquid super cooler connected to a liquid pipe for connecting said condenser with said expansion valve, said liquid super cooler being cooled by a liquid coolant which is reduced in pressure and extracted from said pipe, and said screw compressor having a gas injection opening which is located at a position where the screw blades of the screw compressor have at least partially compressed the gas in the screw compressor and through which the gas coolant from the gas phase portion of the liquid super cooler is sucked into the screw compressor, wherein the position of the gas injection opening provided in the screw compressor and intended to pass the gas from the liquid super cooler into the screw compressor is limited under such a condition that $$V_i = 1.0 \sim 4.5$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the gas injection opening.

2. A refrigerating apparatus according to claim 1, wherein the area factor of the gas injection opening $$C = \frac{\text{the area of the gas injection opening (mm}^2)}{\text{the theoretically maximum screw space volume in the screw compressor (m}^3/\text{h)}} = 0.1 \sim 2.5.$$

3. A refrigerating apparatus according to claim 2, wherein the gas injection opening is opened in the circumferential portion of a rotor casing including no portion into which a slide valve of the screw compressor is provided.

4. A refrigerating apparatus according to claim 2, wherein the gas injection opening is opened in a portion corresponding to a portion of the side face of a bearing head which is located at the side of a female rotor.

5. A refrigerating apparatus comprising a refrigerating cycle into which a screw compressor, a condenser, an expansion valve, and an evaporator are incorporated, said screw compressor having a gas injection opening and having a liquid coolant injection opening which is located at a position where the screw blades of the screw compressor have at least partially compressed the gas in the screw compressor and through which a liquid coolant extracted from a liquid pipe for connecting said condenser with said expansion valve is injected into the screw compressor so that the compressed gas and oil are maintained at a low temperature, wherein the position of the liquid coolant injection opening provided in the screw compressor and intended to pass the liquid coolant into the screw compressor is limited under such a condition that $$V_i = 1.0 \sim 3.7$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the liquid coolant injection opening.

6. A refrigerating apparatus according to claim 5, wherein $$\text{the area factor of the gas injection opening} = \frac{\text{the area of the liquid coolant injection opening (mm}^2)}{\text{the theoretically maximum screw space volume in the screw compressor (m}^3/\text{h)}} = \text{more than } 0.02.$$

7. A refrigerating apparatus according to claim 6, wherein the liquid coolant injection opening is opened on an end face of a bearing head of the screw compressor at discharge side thereof.

8. A refrigerating apparatus according to claim 6, wherein the liquid coolant injection opening is opened in the circumferential portion of a rotor casing including no portion into which a slide valve of the screw compressor is provided.

9. A refrigerating apparatus according to claim 5, further comprising a liquid super cooler connected to a liquid pipe for connecting said condenser with said expansion valve, said liquid super cooler being cooled by a liquid coolant which is reduced in pressure and extracted from said liquid pipe so as to be heat exchanged therebetween, and the gas coolant in the gas phase portion of the liquid super cooler being sucked through said liquid coolant injection opening into the screw compressor.

10. A refrigerating apparatus comprising a refrigerating cycle into which a screw compressor, a condenser, an expansion valve, and an evaporator are incorporated, and a liquid super cooler connected to a liquid pipe for connecting said condenser with said expansive valve, said liquid super cooler being cooled by a liquid coolant which is reduced in pressure and extracted from said liquid pipe, and said screw compressor having a liquid coolant injection opening which is located at a position where the screw blades of the screw compressor have at least partially compressed the gas in the screw compressor and through which said liquid coolant extracted from said pipe is injected into the screw compressor so that the compressed gas and oil are maintained at a low temperature, and having a gas injection opening which is located at a position where the screw blades of the screw compressor have at least partially compressed the gas in the screw compressor and through which the gas coolant in the gas phase portion of the liquid super cooler is sucked into the screw compressor, wherein the position of the liquid coolant injection opening provided in the screw compressor and intended to pass the liquid coolant into the screw compressor is limited under such a condition that $$V_i = 1.0 \sim 3.7$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the liquid coolant injection opening and the position of the gas injection opening provided in the screw compressor and intended to pass the from the liquid super cooler into the screw compressor is limited under such a condition that $$V_i' = 1.0 \sim 4.5$$

in which $$V_i = \frac{V_L}{V_H},$$

$V_L$ represents the theoretically maximum screw space volume ($m^3/h$) in the screw compressor and $V_H$ represents the screw space volume ($m^3/h$) at the position of the gas injection opening.

* * * * *